US005437082A

United States Patent [19]

Maenaka

[11] Patent Number: 5,437,082

[45] Date of Patent: Aug. 1, 1995

[54] DEVICE FOR DETECTING AND REPAIRING YARN DEFECTS IN A WARPER

[75] Inventor: Koyu Maenaka, Mattou, Japan

[73] Assignee: Tsudakoma Kogyo Kabushiki Kaisha, Ishikawa, Japan

[21] Appl. No.: 44,292

[22] Filed: Apr. 7, 1993

[30] Foreign Application Priority Data

Sep. 4, 1992 [JP] Japan ..... 4-089074

[51] Int. Cl.[6] ..... B65H 54/00; D02H 3/00

[52] U.S. Cl. ..... 28/190; 28/185; 139/351; 242/534; 242/523.1

[58] Field of Search ..... 28/172.1, 185, 186, 28/187, 194, 195, 196, 201, 209, 210, 211, 190; 139/35, 351; 242/534, 527, 523.1; 226/10, 24, 45

[56] References Cited

U.S. PATENT DOCUMENTS

| | | | |
|---|---|---|---|
| 3,142,831 | 7/1964 | Horne et al. | 28/185 |
| 3,765,777 | 10/1973 | Williams, Jr. | 28/185 |
| 3,795,906 | 3/1974 | Erbstein | 28/185 |
| 4,974,301 | 12/1990 | Beerli et al. | 28/195 |
| 5,111,851 | 5/1992 | Takgawa | 28/209 |

FOREIGN PATENT DOCUMENTS

| | | |
|---|---|---|
| 4311486 | 3/1968 | Japan . |
| 4363526 | 5/1986 | Japan . |
| 61-239038 | 10/1986 | Japan . |
| 62-10836 | 5/1987 | Japan . |

*Primary Examiner*—Peter Nerbun
*Assistant Examiner*—Larry D. Worrell, Jr.
*Attorney, Agent, or Firm*—Christopher R. Pastel; Thomas R. Morrison

[57] ABSTRACT

A defective yarn repairing device of a warper, the defective yarn repairing device comprising a yarn detecting device for detecting a defective yarn contained in a warp; a yarn pulling device for pulling out the defective yarn from the warp; and a positioning device which has a knotter and positions the defective yarn pulling device at the position corresponding to the ascertained location of the defective yarn, wherein the positioning device causes the defective yarn pulling device to be moved in the widthwise direction of the warp; the defective yarn detecting device stops upon ascertaining the location of a defective yarn; the defective yarn pulling device pulls out the detected defective yarn from the warp; and wherein the knotter repairs the fluffy yarn.

2 Claims, 13 Drawing Sheets

DEVICE FOR DETECTING AND REPAIRING YARN DEFECTS IN A WARPER

BACKGROUND OF THE INVENTION

1. Field of the Invention

The present invention relates to a warper and, more precisely, to a defective yarn repairing device of a warper for removing a defective part from a yarn contained in a warp and repairing the yarn with improved efficiency.

2. Description of the Prior Art

A warper referred to herein is a machine used at a weaving factory for drawing yarns from numerous yarn packages on a creel, forming them into a warp and then making a warp beam by taking up the warp.

In general cases, the occurrence of fluff in a yarn forming a warp beam is a serious obstacle in the subsequent weaving process, because the presence of fluff hinders smooth warp shedding and/or causes considerable deterioration in the quality of a woven cloth. Therefore, whenever fluff is found even in a single yarn among numerous yarns comprising a warp, the warper has to be halted immediately for removal of the defective part and repair of the yarn from which the defective part is removed. Conventional and widely known fluff detectors used for such purpose include, for example, those disclosed in Japanese Patent Publication No. 6352/1968 and Japanese Utility Model Publication No. 11486/1968.

When a fluff detector has caused a warper to stop, it is necessary to find and mend the yarn containing fluff (hereafter to be referred to as "defective yarn") among the numerous yarns which form the warp. In actual operation, the search for and picking out of a defective yarn depends entirely on human eyesight and manual operation. However, there exist some known methods intended to reduce the trouble of manual operation to some extent by means of the improved fluff detector which is capable of ascertaining the location of a defective yarn in relation to the width of the warp. Examples of such devices include those disclosed in Japanese Patent Publications Laid-Open Nos. 239038/1986 and 108136/1987. The latter of the two inventions is capable of detecting the location of a defective yarn with high accuracy by means of projecting laser beams across the warp and detecting light reflected by fluff with a plurality of CCD cameras.

According to such a conventional art, the location of a defective yarn contained in the warp may be accurately ascertained, but a continuous process of pulling the defective yarn from the warp and removing the defective part has to be done manually, which still requires a high degree of skill for the repairing operation, making it on the whole troublesome. It is difficult to pick up a desired yarn by hand without any damage to other yarns, because a large number of yarns are very closely arranged in the warp. Furthermore, it often happens that wind pressure or other force causes fluff, which may have been sticking out from the surface of the yarn at the time it passed the detection range of the fluff detector, to be lying fiat on the yarn or moved around to the back of the warp, making the finding of the defective yarn itself extremely difficult when the yarn is going to be pulled.

OBJECTS AND SUMMARY OF THE INVENTION

Accordingly, it is an object of the present invention to provide a defective yarn repairing device which is incorporated in a warper and is capable of automatically accomplishing the process of pulling out a defective yarn, which is the most difficult portion in a series of repairing steps for defective yarns, consequently making the repairing process on the whole much easier and efficient.

Briefly stated, an apparatus according to the present invention comprises a defective yarn detecting means for ascertaining the location of a defective yarn relative to the width of a warp containing the defective yarn in question, a fluffy yarn pulling means for pulling out the defective yarn from the warp, and a positioning means for moving the defective yarn pulling means in the widthwise direction of the warp, and positioning the defective yarn pulling means at the position corresponding to the said location of the defective yarn according to signals from the defective yarn detecting means.

The positioning means mentioned above may simultaneously move both the defective yarn pulling means and the defective yarn detecting means. The defective yarn detecting means being comprised of a camera device.

The positioning means may be provided with a knotter for cutting off the defective part from a defective yarn pulled out by the defective yarn pulling means and tying ends of the cut off yarn together and/or a slack prevention device for applying tension to the tied yarn at the time of restarting the warper. The said knotter may be provided with a suction pipe for disposing defective parts removed by the knotter.

The said camera device may have a pair of windows within its field of vision. The defective yarn pulling means may be a hook having a separator.

As described above, an apparatus according to the present invention has such a structure that the location of a defective yarn is ascertained by the defective yarn detecting means in relation to the width of the warp containing the defective yarn and that the positioning means moves the defective yarn pulling means in the widthwise direction of the warp, based on information from the defective yarn detecting means. Therefore, the defective yarn pulling means thus moved and positioned is able to pull out the defective yarn immediately from the warp, thereby permitting a worker to easily remove the defective part from the pulled-out yarn.

According to an embodiment of the invention wherein the defective yarn detecting means is composed of a camera device which is moved by the positioning means simultaneously with the defective yarn pulling means, with the relative situation between the defective yarn pulling means and the defective yarn detecting means being constantly fixed. Therefore, the danger of the defective yarn pulling means accidentally pulling a normal yarn instead of a defective yarn is minimized.

According to another embodiment of the invention wherein a knotter is added to the structure of the above embodiment, it is possible to fully automate the entire continuous process of repairing a defective yarn, as removal of the defective part from a defective yarn pulled out by the defective yarn pulling means and tying ends of the removed yarn is accomplished by the knotter.

According to yet another embodiment of the present invention, a slack prevention device may be advantageously added to the structure in order to prevent a repaired yarn, from which a defective part has been removed, from becoming slack when the warper is restarted and thus permit the repaired yarn to smoothly return to the warp.

As described above, according to the present invention, there are provided a defective yarn detecting means, a defective yarn pulling means and a positioning means so that the location of a defective yarn in a warp can be ascertained by the defective yarn detecting means and that the defective yarn pulling means can be positioned by the positioning means at a specified location where it is able to pull out the defective yarn from the warp. Therefore, the present invention is effective in making the entire operation of repairing defective yarns much easier and highly efficient, because it is capable of fully automating the process of finding and pulling out a defective yarn, which is the most troublesome process and requires the highest degree of skill.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
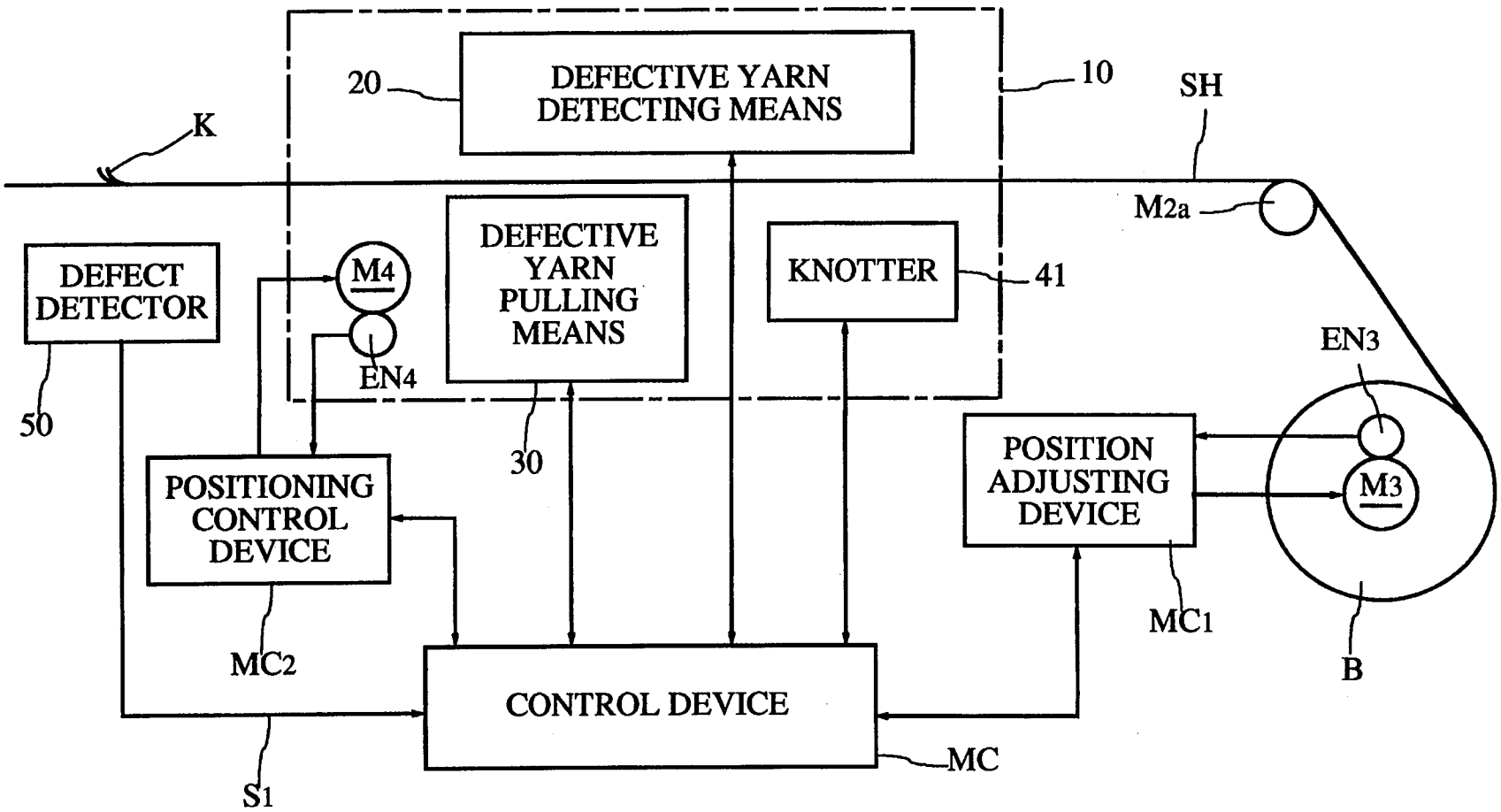
FIG. 1 is a simplified general diagram illustrating the structure of an embodiment of the present invention.
Figure 2:
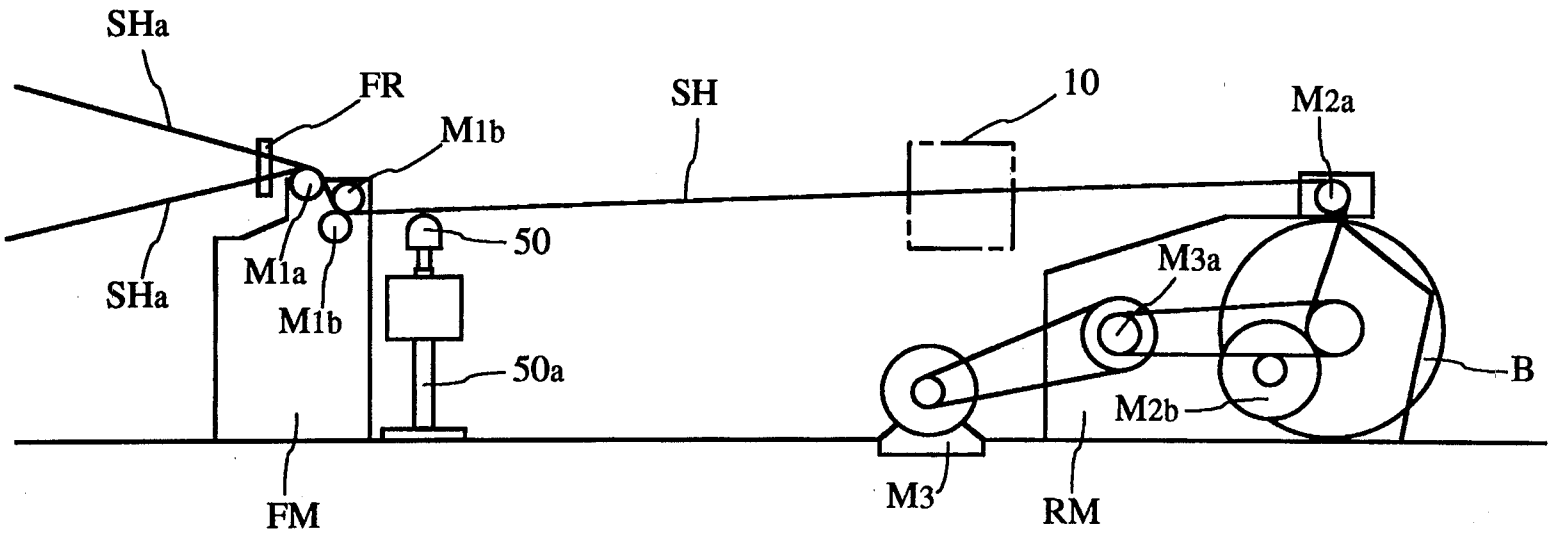
FIG. 2 is a simplified side view of a warper incorporating the said embodiment.

In FIGS. 1 and 2, a defective yarn repairing device of a warper according to an embodiment of the present invention has a defective yarn detecting means 20, a defective yarn pulling means 30 and a knotter 41 to be mounted on positioning means 10 and is positioned, in combination with a fluff detector 50, between a front stand FM and a rear stand RM of the warper.

A warper principally consists of a guide roller M1a tension rollers M1b/M1b to be incorporated with front stand FM, a warp beam B which is installed on rear stand RM, a measuring roller M2a which is positioned over the warp beam B, and a pressure roller M2b which is in contact with the surface of warp beam B, wherein warp beam B may be driven by a main motor M3. Main motor M3, however, must be connected through an intermediate shaft M3a to warp beam B, and a brake (not shown) can be operated on the warp beam B whenever necessary.

Numerous yarns SHa, SHa . . . pulled out of a creel (not shown) are parallelly arranged through a front reed FR in front of front stand FM at prescribed intervals and then led to tension rollers M1b/M1b through guide roller M1a. Having passed between the tension rollers M1b/M1b, yarns SHa, SHa . . . are transformed into a warp SH and taken up by warp beam B through measuring roller M2a.

Fluff detector 50 is installed on a stand **50*a*, behind front stand FM, and has such a configuration as to be able to detect fluff K of defective yarn SH1 contained in a warp SH and output signals S1** which indicate the presence of the fluff by means of, for example, projecting laser beams across warp SH from near the warp SH.

Fluff signals S1 from fluff detector 50 are input in a control device MC, which has a position adjusting device MC1 and a positioning control device MC2. Output of position adjusting device MC1 is connected to main motor M3, and output of a rotary encoder EN3 for detecting the number of revolutions of main motor M3 is fed back to position adjusting device MC1. Gdiput of positioning control device MC2 is connected to a servomotor M4 which drives a positioning means 10, and output of a rotary encode; EN4 for detecting the number of revolutions of servomotor M4 is fed back to positioning control device MC2.

The positioning device 10 comprises a rail 11 for linear movement, rail 11 being provided over a warp SH in the widthwise direction thereof (see FIGS. 3 and 4), and a carriage 12 movable on the rail 11. The position of carriage 12 can be set by laterally moving itself along the rail 11 by means of forwarding or reversing servomotor M4. A comb CM is provided below rail 11 and carriage 12 in order to assure stable movement of sheet of yams SH. In case of FIG. 3, warp SH moves from left to right in relation to the page on which the drawing is represented, whereas, in FIG. 4, sheet SH moves from the surface of the paper towards the back, i.e. going away from the viewer in a direction perpendicular to the surface of the paper.

Figure 5:
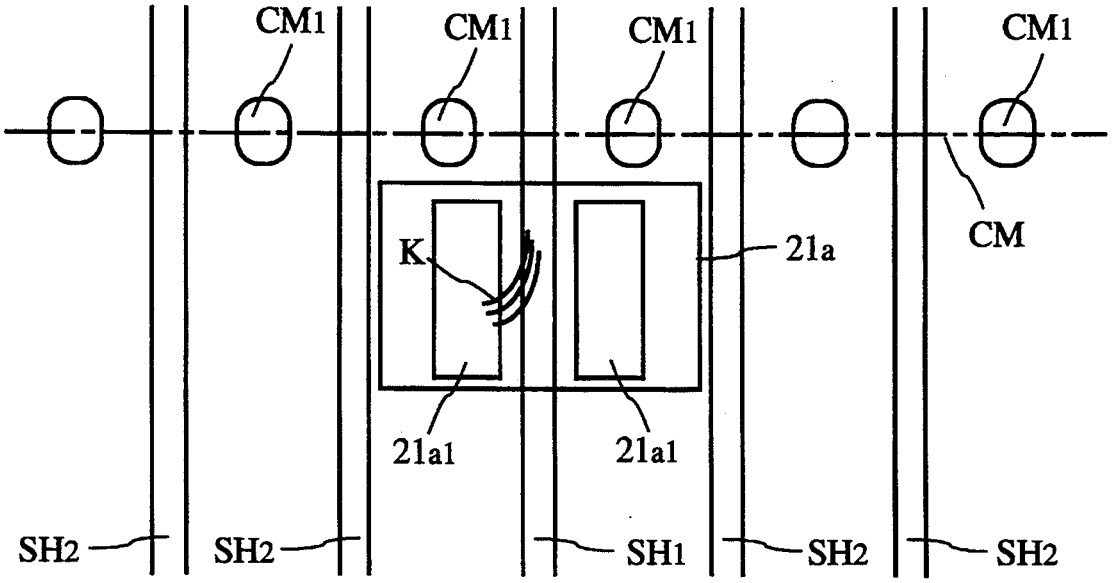
FIG. 5 is an explanatory drawing of fluff-detecting windows of the said embodiment.

A camera device 21 which makes up defective yarn detecting means 20 is mounted by means of a bracket **20*a* on carriage 12. Camera device 21 is so positioned at the upstream side of comb CM as to face warp SH. Within its field of vision 21*a* camera device 21 has a pair of small windows 21a1/21a1 for detecting fluffs in any yarn SHa (a=1 or 2) therebetween, the path of yarns SH being controlled by teeth CM1/CM1/. . . of comb CM (see FIG. 5). In FIG. 5, codes SH1 and SH2 respectively represent a defective yarn which has fluff K and a normal yarn without fluff, defective yarn SH1 and normal yarns SH2/SH2/**. . . collectively comprising a warp SH.

Figure 3:
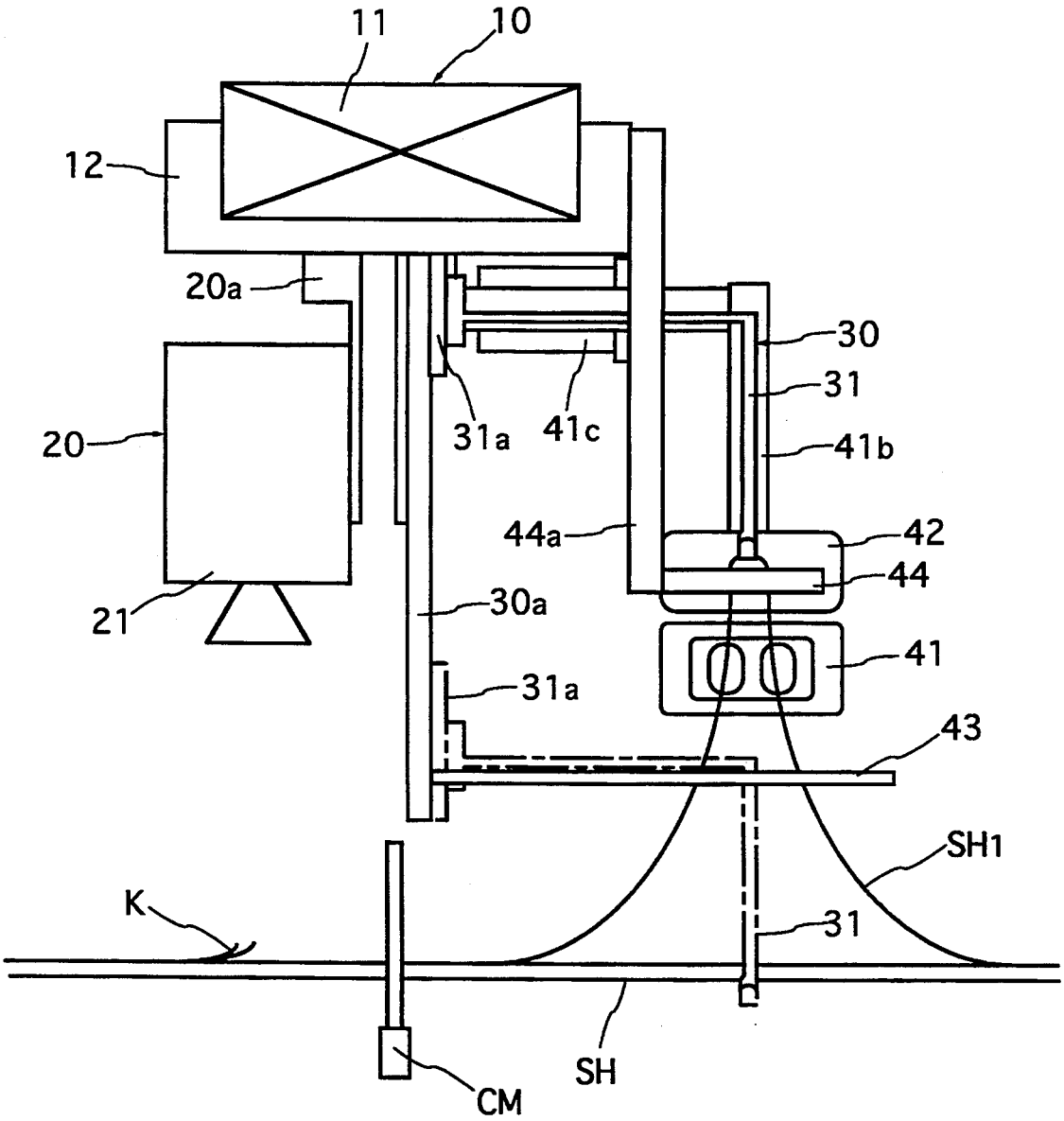
FIG. 3 is a side view of the principal parts of a positioning means of the said embodiment.
Figure 4:
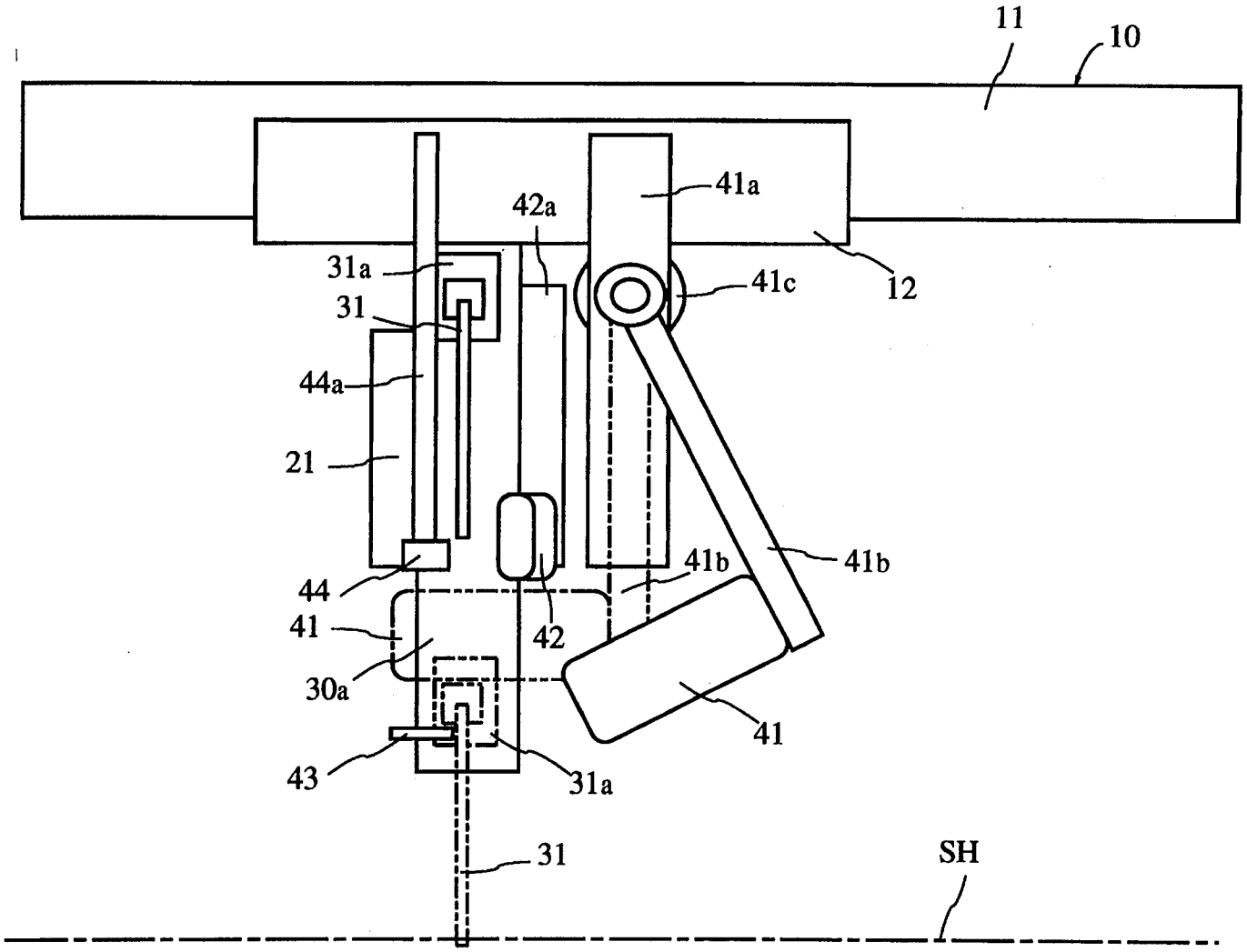
FIG. 4 is a front view of FIG. 3.

A hook 31 which constitutes a part of defective yarn pulling means 30 is so attached by means of a bracket 30*a* to carriage 12 as to face warp SH (see FIGS. 3 and 4). As hook 31 is vertically movable on bracket 30*a*, with a movable bracket 3 la therebetween, it is possible to move hook 31 down to the position where hookend may be penetrated through the warp SH at the downstream side of comb CM (represented by two-dot chain lines in FIGS. 3 and 4) and then pull a yarn SHa upward from the sheet of yams SH by moving hook 31 upward (represented by solid lines in FIG. 3). FIG. 3 illustrates a state where hook 31 has drawn up defective yarn SH1.

A knotter 41 is mounted on carriage 12 by means of a bracket 41*a* and a swing lever 41*b*. Swing lever 41*b* is connected to a motor 41*c* and can be swung in the widthwise direction of warp SH by means of operating motor 41*c* in the forward or reverse direction. By swinging swing lever 41*b*, knotter 41 is moved to the retreated position (represented by solid lines in FIG. 4) away from hook 31 or the forward position (represented by two-dot chain lines in FIG. 4) where knotter 41 intersects the locus of vertical movement of hook 31.

Carriage 12 is also provided with a suction pipe 42, a yarn guide 43 and a yarn sensor 44.

One of the ends of suction pipe 42 is connected to a vacuum source (not shown), and the other end has its opening near the end of hook 31 at its raised position with a bracket 42*a*. Yarn guide 43, projected from the bottom of bracket 30*a*, is a bar having a pair of pins 43*a*/43*a* which are projected towards knotter 41 (see FIG. 6). Pins 43*a*/43*a* are formed in order to adjust defective yarn SH1 at the right position in from of knotter 41 when the yarn is pulled up by hook 31. Yarn sensor 44 is so positioned as to face the opening of suction pipe 42, with bracket 44*a* therebetween (see FIGS. 3 and 4). Yarn sensor 44 is capable of detecting defective yarn SH1 pulled up by hook 31.

Figure 7:
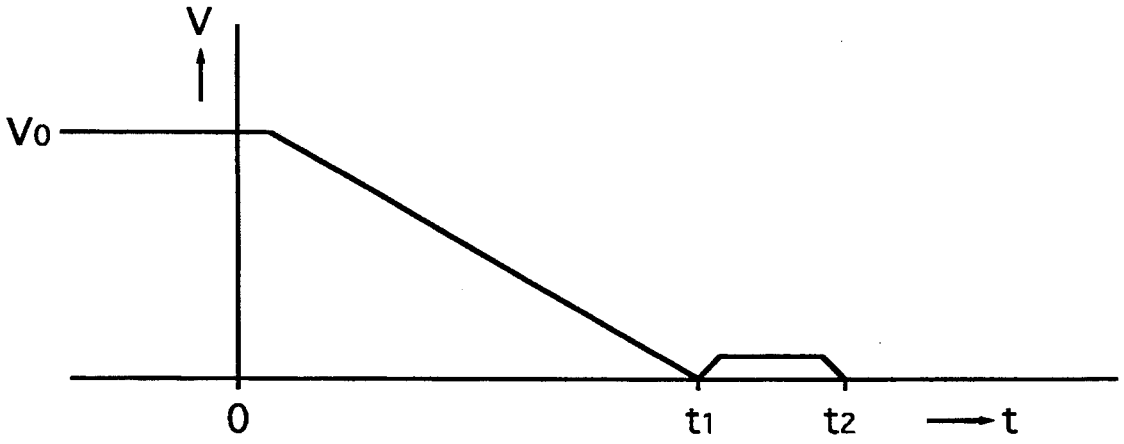
FIG. 7 is an explanatory drawing illustrating function of a warper of said embodiment.

When a warper is in regular operation at the yarn speed of $V=V_0$ (the portion where "t"representing time is less than 0 in FIG. 7: hereinafter referred to as "$t<0$"), carriage 12 is stationed at one side in the widthwise direction of warp SH. Knotter 41 is at its retreated position.

When defective yarn SH1 having fluff K gets mixed into yarns SHa/SHa/. . . to be made into warp SH, fluff detector 50 detects fluff K and outputs fluff signal S1 ($t=0$). In response to the signal, control device MC cuts off power supply to main motor M3 and actuates the brake on warp beam B, thereby halting the warper according to a prescribed speed reduction curve ($0<t<t1$).

As position adjusting device MC1 is capable of calculating inertial running distance L1 of fluff K during the period $0<t<t1$ by using output of the encoder EN3, position adjusting device MC1 is also capable of moving fluff K to a position generally corresponding to where camera device 21 is set up by means of inching main motor M3 after the warper has been halted ($t1<t<t2$). In such a case, the desired distance L2 of inching by position adjusting device MC1 shall satisfy the equation $L2=L0-L1$, L0 representing the distance between fluff detector 50 and camera device 21. The braking force of the brake when halting the warper shall be so set as to make inertial running distance L1 during the braking period not exceed distance L0, i.e. $L1<L0$.

When using output signals of encoder EN3, which detects the number of revolutions of main motor M3, position adjusting device MCi detects the diameter of warp beam B, based on the location of pressure roller M2b, converts the number of revolutions of main motor M3 to the travelling distance of warp SH and then adjusts the position of fluff K as described above. However, encoder EN3 may be arranged so as to detect the number of revolutions of measuring roller M2a instead of detecting that of main motor M3, i.e. the number of revolutions of warp beam B. In that case, said conversion based on the diameter of warp beam B is not necessary.

By providing another fluff detector at a position where camera device 21 is installed or immediate to the upstream side of camera device 21, fluff K may be moved more accurately to a position corresponding to the position of camera device 21. In that case, however, it is desirable that when fluff K comes close to where camera device 21 is positioned, position adjusting device MC1 has slowed down main motor M3 to a sufficiently low speed by utilizing fluff detector 50 and stops the motor upon detection of fluff K by the another fluff detector.

When position adjusting device MC1 has completed position adjusting of fluff K, control device MC starts positioning control device MC2. As positioning control device MC2 actuates servomotor M4, thereby moving carriage 12 forward, in the widthwise direction of warp SH, camera device 21 is then able to move across warp SH and thus scan yarns SHa/SHa/. . . that make up warp SH. The camera device 21 has a pair of windows 21a1/21a1 within its field of vision (see FIG. 5). Therefore, when yarn SHa is between the two windows 21a1/21a1, camera device 21 is able to recognize fluff K in one of the windows, thereby detecting that yarn SHa in question is defective yarn SH1. In cases where neither window finds fluff K, yarn SHa between windows 21a1/21a1 is normal yarn SH2.

When camera device 21 has thus detected defective yarn SH1, control device MC stops positioning control device MC2, stops carriage 12 and actuates defective yarn pulling means 30. In other words, control device MC causes hook 31 to be moved down to the lowest position and then moved upward, thereby allowing hook 31 to pull up defective yarn SH1 detected by camera device 21 (see FIG. 3). For this purpose, hook 31 must be so mounted on carriage 12 as to be at the right position in relation to camera device 21, i.e. the position as to allow hook 31 to catch defective yarn SH1 when carriage 12 stops, following the detection of defective yarn SH1 by camera device 21.

Figure 6:
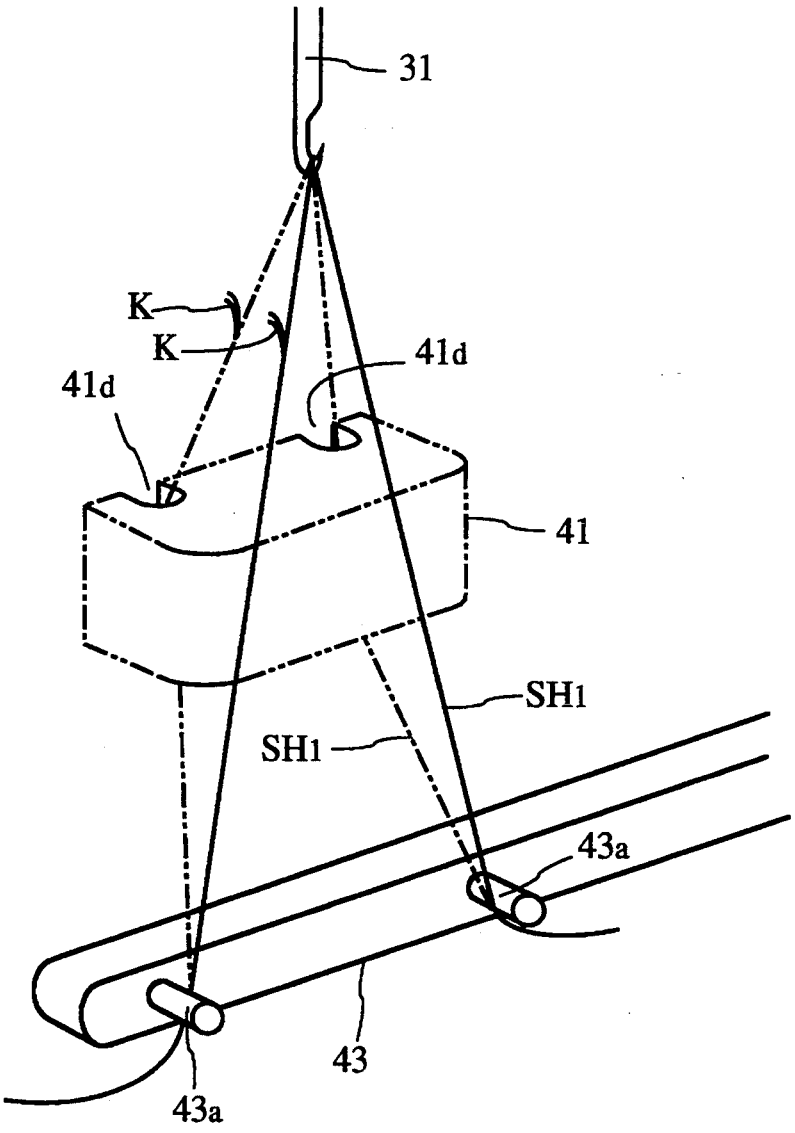
FIG. 6 is a perspective view of a hook and a yarn guide of the said embodiment.

Defective yarn SH1 pulling up by hook 31 may be adjusted by yarn guide 43 to the proper angle in front of knotter 41, which is at its retreated position (see SH1 represented by solid lines in FIG. 3 and 6). At that time, defective yarn SH1 can be detected by yarn sensor 44.

Then, by means of motor 41*c*, control device MC causes swing lever 41 to swing, thereby moving knotter 41 to its forward position. As knotter 41 moves forward to intersect the locus of vertical movement of hook 31 (as shown in two-dot chain lines in FIG. 4), it permits defective yarn SH1 to be positioned so as to be exposed to appropriate tension and fitted in a pair of yarn arranging guides 41*d*/41*d* of knotter 41 (as shown in two-dot chain lines in FIG. 6). The length of the portion of defective yarn SH1 pulled out by hook 31 shall be such that fluff K detected by camera device 21 is at a position higher than knotter 41 at its forward position. In other words, when defective yarn SHI has been pulled up by hook 31, additional yarn, the length of which corresponds to the pulled-up portion, is supplied by a creel (not shown), so that fluff K is moved forward, passing through comb CM, until it comes above knotter 41. Before defective yarn SH1 is pulled, tension rollers M1b/M1b must be spaced apart in order to permit supply of additional yarn.

Next, control device MC actuates knotter 41, which is capable of cutting defective yarn SH1 caught in yarn arranging guides 41*d*/41*d* at two locations therein and tying the yarn which has just been cut. More precisely, knotter 41 is capable of cutting only the part above knotter 41, in other words the part having fluff K, out of defective yarn SH1 and then tying the remaining yarn together. Meanwhile, the defective portion cut out by knotter 41 is sucked off hook 31 by suction pipe 42 and disposed through the pipe to the exterior of the system.

Then, after causing knotter 41 to move back to its retreated position and carriage 12 of positioning means 10 to move to one side of warp SH, control device MC restarts the warper. At that time, yarn SH1 tied together by knotter 41 is somewhat slack, compared with other yarns SH2/SH2/. . . Nevertheless, as the excessive length causing the slack is, in general cases, minimal in relation to the distance between tension rollers M1b/M1b and measuring roller M2a of the warper, such a slack presents no practical problem.

Figure 8:
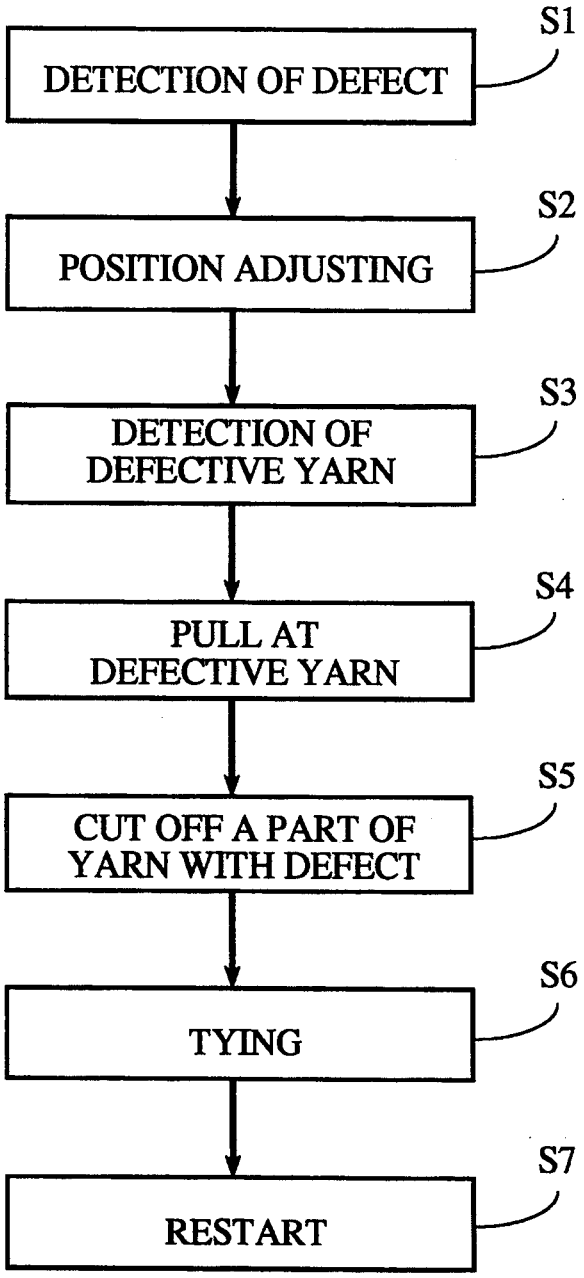
FIG. 8 is a flow chart illustrating function of the embodiment.

The function of the present embodiment described above is summarized in FIG. 8. More precisely fluff K is detected by fluff detector 50 (Step (1) in FIG. 8: hereafter simply referred to as (1)), and the warper is halted. Thereafter, fluff K is positioned almost directly below camera device 21 by means of position adjusting device MC1 (2), and camera device 21 is driven by positioning control device MC2 and positioning means 10 in order to detect defective yarn SHI(3). Then, having been pulled up by hook 31 (4), defective yarn SH1 is removed of the defective part (5) and tied together again (6) by knotter 41. Then, control device MC causes the warper to restart (7).

Figure 9:
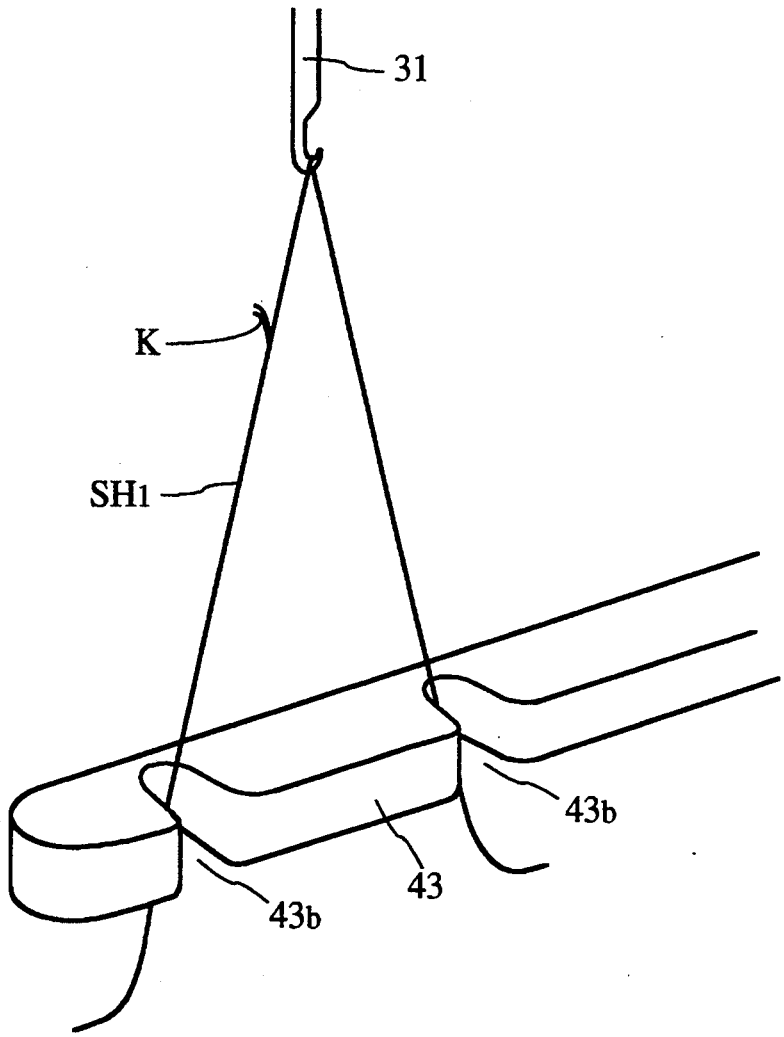
FIG. 9 is a perspective view of another embodiment of a yarn guide according to the present invention.

As shown in FIG. 9, instead of pins 43*a*/43*a*, yarn guide 43 may be provided with recesses 43*b*/43*b* for guiding defective yarn SH1.

Camera device 21 may be of any type as long as it is capable of scanning yarns SHa/SHa/. . . over warp SH and thus detecting defective yarn SH1. In other words, camera device 21 may be a conventional video camera using a CCD or a camera tube or what is generally called a line image sensor to be installed over the entire width of warp SH. The method utilized by camera device 21 to recognize the presence of fluff K may also be any image processing method, depending on the length and/or condition of fluff K. For example, the presence of fluff K may be detected by camera device 21 by filming yarns SHa/SHa/. . . , which make up warp SH, one by one or a plurality of yarns each time and measuring the projected area or the length of the outline of the projected image of a portion of the filmed yarn SHa defined by a prescribed length.

Figure 10:
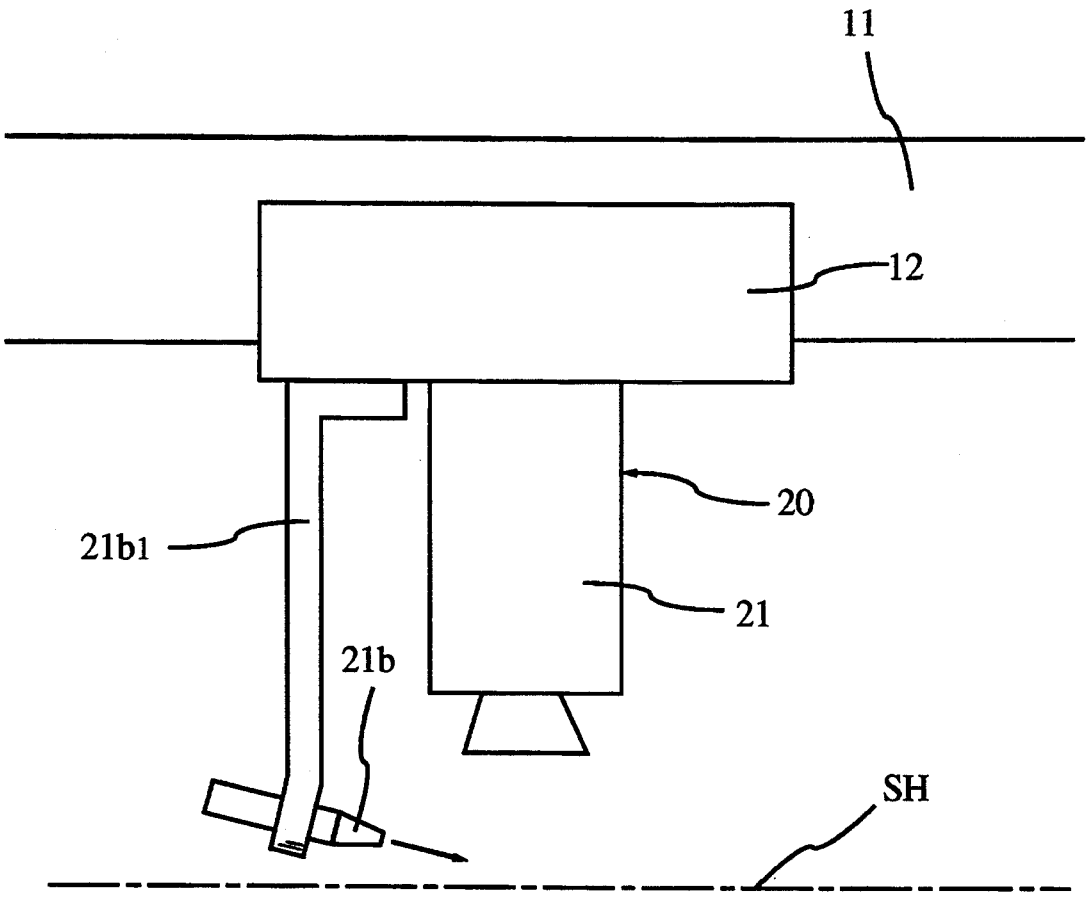
FIG. 10 illustrates another structural example of the camera device of the embodiment and corresponds to FIG. 4.

As shown in FIG. 10, camera device 21 may have an air nozzle 21*b* with a bracket 21*b*1 therebetween. When camera device 21 moves across warp SH to detect fluff K, air nozzle 21*b* blows air across warp SH (in the direction represented by the arrow in FIG. 10), thereby causing fluff K of defective yarn SH1 to stick out laterally from warp SH so that camera device 21 is able to detect it more reliably. Fluff detector 50 may also be provided with a similar air nozzle 21*b*. In that case, however, it is preferable to position the air nozzle above sheet yam SH and permit it to blow air like an air curtain across warp SH, along laser beams projected from below with the warp SH in the widthwise direction.

A suction pipe 42 is not always necessary, because a defective part of yarn removed by knotter 41 may easily be blown away by wind pressure when the warper, after restarting, resumes movement of warp SH.

Fluff detector 50 may be, instead of a laser-beam-projection type, of a type which uses a standard photoelectric sensor (such as the art disclosed in Japanese Patent Publication No. 16463/1973) or a mechanical type detector (such as the art disclosed in Japanese Utility Model Publication No. 11486/1968).

Function of fluff detector 50 is not limited to detection of the presence of defective yarn SH1 with fluff K in warp SH; it may also be capable of ascertaining the location of warp yarn SH1 (such as the arts disclosed in Japanese Patent Publication Nos. 16463/1973 and 2056/1986 and Japanese Patent Publication Laid-open No. 239038/1986). In that case, fluff detector 50 is capable of outputting information concerning the location of warp yarn SH1 as well as fluff signals S1, thereby permitting control device MC to drive, through positioning control device MC2, carriage 12 of positioning means 10 to a desired position in accordance with the said output signals concerning the location of the warp yarn. This means that fluff detector 50 also serves as warp yarn detecting means 20, which is the function served by camera device 21 in case of the embodiment described above. Therefore, camera device 21 may be omitted in such a configuration.

Figure 11:
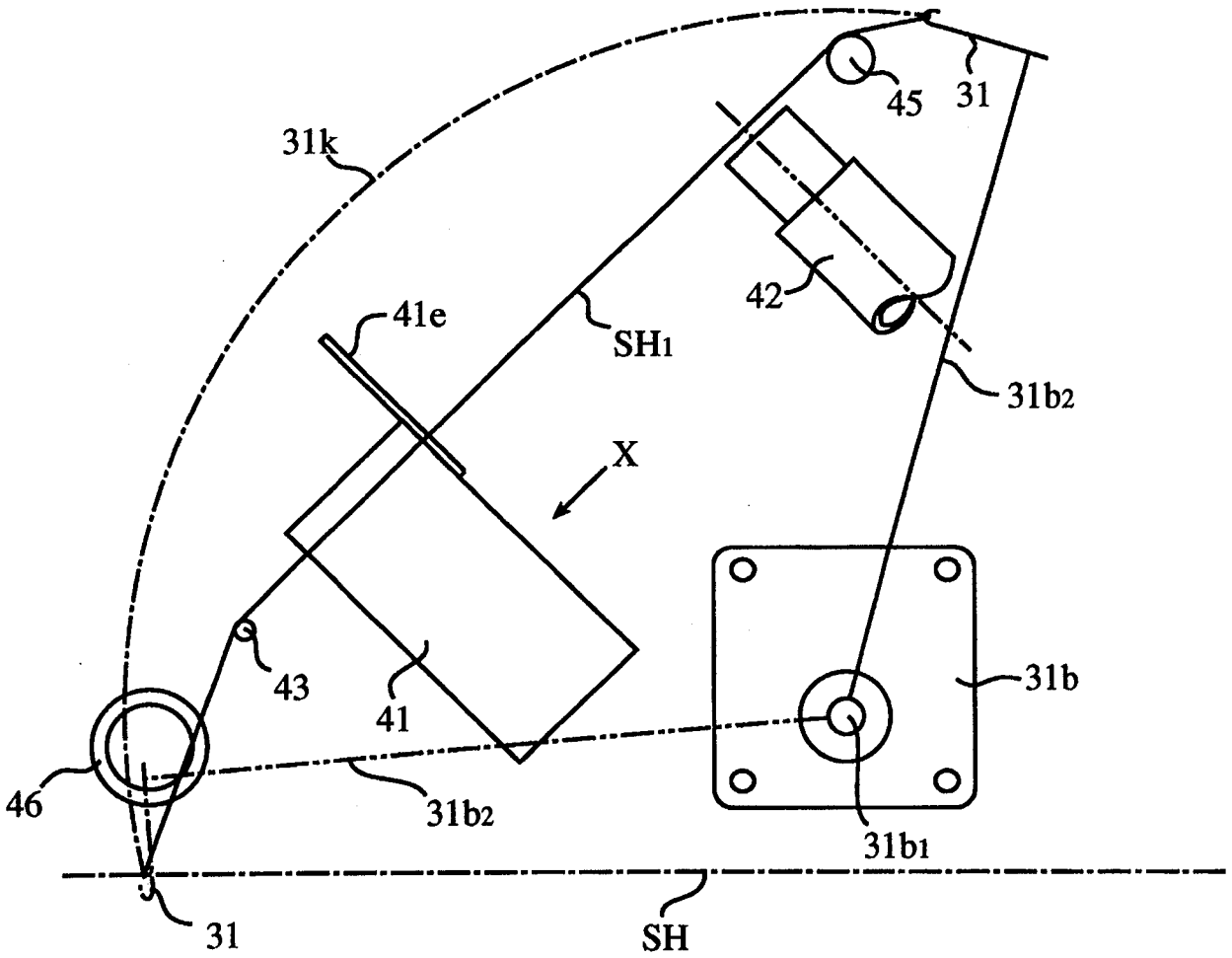
FIG. 11 illustrates another structural example of a hook and corresponds to FIG. 4.

As shown in FIG. 11, hook 31 may be moved in swing motion, instead of vertical movement, by motor 31*b* specially provided for this purpose. In that case, hook 31 is fixed to the head of arm 31*b*2, which is connected to shaft 31*b*1 of motor 31*b*, and is moved along arc-like locus 31*k* between the highest position (represented by solid lines in FIG. 11) and the lowest position (represented by two-dot chain lines in FIG. 11) by means of rotating motor 31*b*. In FIG. 11, warp SH moves away from the viewer, perpendicular to the surface of the paper of the drawing. Being moved to its lowest position and then to its highest position, hook 31 pulls defective yarn SH1 diagonally upward. Defective yarn SH1 thus pulled up by the hook is adjusted at the right position and angle by yarn guide 43, upper yarn guide 45 and yarn guide 41*e* formed on knotter 41. After hook 31 has returned to its highest position, by actuating suction pipe 42 and lowering hook 31 slightly, defective yarn SH1 may be taken off hook 31 so that the end of the yarn can easily be sucked into suction pipe 42.

Figure 12:
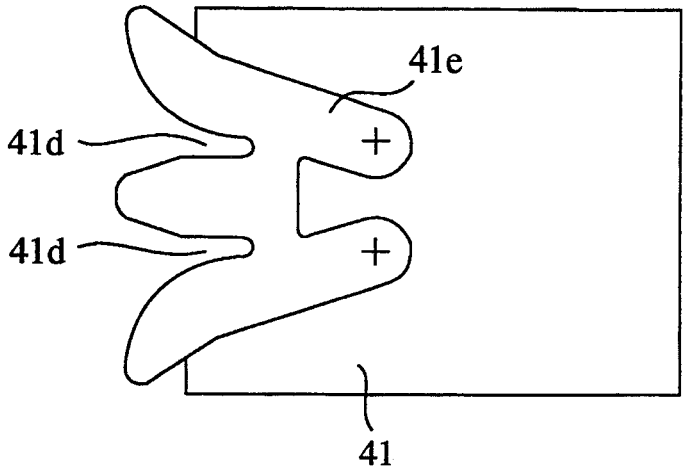
FIG. 12 is a side view which viewed from the arrow X in FIG. 11.

As shown in FIG. 12, by means of securely setting knotter 41 diagonally upward, in such a manner that the knotter faces the path along which a defective yarn is pulled up, i.e. locus 31*k* of hook 31, defective yarn SH1 may be readily introduced into yarn arranging guides 41*d*/41*d* by yarn guide 41*e*. In that case, however, yarn guide 41*e* shall have a forked shape to permit defective yarn SH1 to be smoothly introduced into yarn arranging guides 41*d*/41*d* of the knotter 41.

Figure 13:
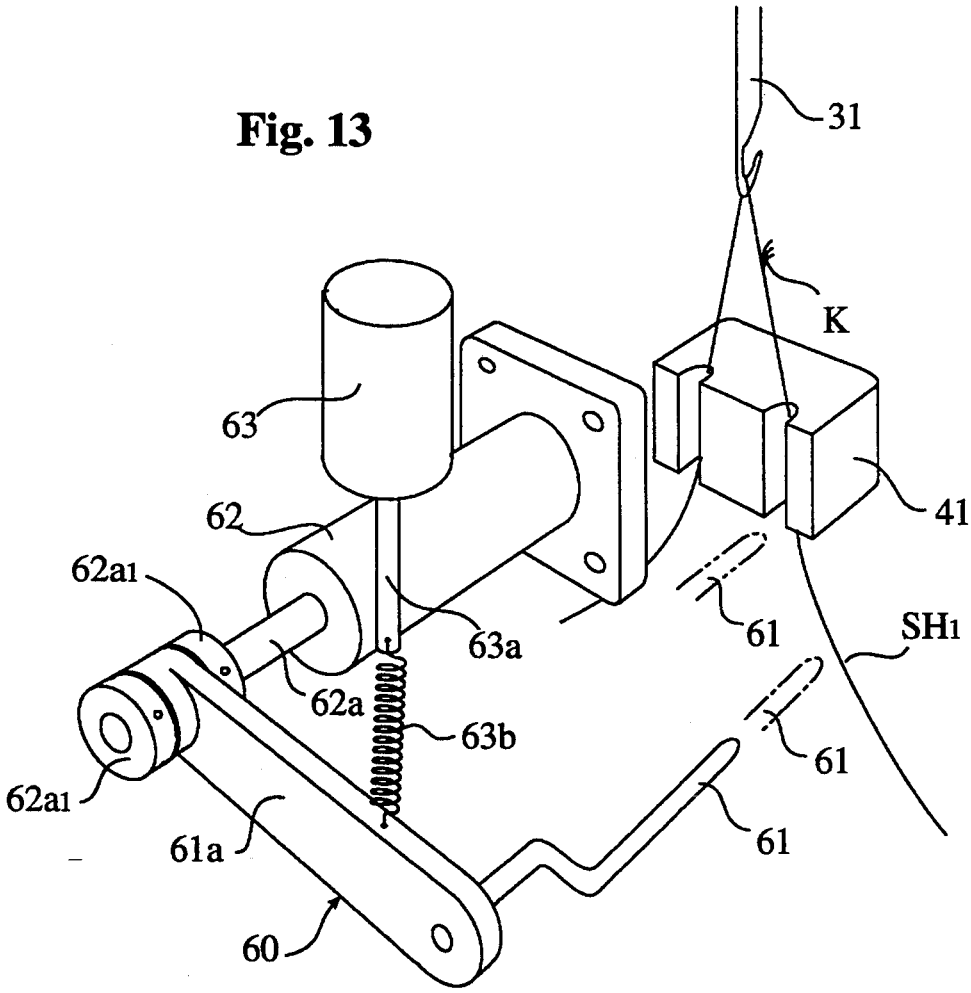
FIG. 13 is a perspective view of the principal parts of another structural example of the slack prevention device of the embodiment.

In the embodiment shown in FIG. 11, an auxiliary suction pipe 46, which is capable of sucking defective yarn SH1 tied by knotter 41 is provided near warp SH so that slack of the defective yarn may be eliminated. However, as shown in FIG. 13, a movable guide 60 which is capable of mechanically catching defective yarn SH1 tied by knotter 41, thereby applying nearly constant tension to defective yarn SH1, may be used instead of auxiliary suction pipe 46.

Such movable guide 60 has a rod-shaped yarn guide 61 and air cylinders 62/63 for driving yarn guide 61, air cylinders 62/63 being so mounted on carriage 12 as to cross at right angles each other. A swing lever 61*a* is rotatably attached through set collars 62*a*1/62*a*1 to rod 62a of air cylinder 62. Yarn guide 61 is so set up at the head of swing lever 61*a* as to face knotter 41 at its forward position. The center portion of swing lever 61*a* is connected to rod 63a of air cylinder 63, with spring 63b therebetween. With the configuration as above, extension of air cylinders 62/63 causes yarn guide 61 to come to its standby position (represented by solid lines in FIG. 13), slightly above warp SH (not shown in the drawing). Then, contraction of cylinder 62 moves yarn guide 61 to its first operating position, and contraction of cylinder 63 to its middle position moves yarn guide 61 to its second operating position. The first operating position mentioned above is represented by one-dot chain lines in FIG. 13, wherein its front end reaches directly below hook 31, which is pulling up a defective yarn, and the second operating position is represented by two-dot chain lines in FIG. 13, wherein its front end is elevated to a level right below knotter 41 at its forward position.

Next, the function of movable guide 60 is explained as follows:

First, when hook 31 has pulled up defective yarn SH1 and knotter 41 has been driven to its forward position, yarn guide 61 is elevated to its second operating position, where it is set at a standstill. Then, when knotter 41, having cut and tied defective yarn SH1 together, is driven to its retreated position, defective yarn SH1 removed of the defective portion drops onto yarn guide 61, by which it stops. Thereafter, air cylinder 63 further contracts, thereby applying appropriate tension through spring 63b to defective yarn SH1.

Then, while restarting the warper, air cylinder 63 is gradually extended until yarn guide 61 comes down to its first operating position. Therefore, as warp beam B takes up warp SH, defective yarn SH1 moves down towards warp SH, while maintaining nearly constant tension. When yarn guide 61 reaches its first operating position, with most of the pulled-up portion of defective yarn SH1 returned into warp SH, air cylinder 62 is extended, thereby returning yarn guide 61 to its standstill position. As a result, defective yarn SH1 comes off yarn guide 61 and completely returns into the warp SH. In cases where defective yarn SH1 is pulled out of a creel under appropriate tension, the aforementioned spring 63b is not essential.

As described above, if installed, an auxiliary suction pipe 46 and/or a movable guide 60 comprise a slack prevention device which applies tension to defective yarn SH1 to prevent the yarn from slacking when the warper is restarted.

Figure 14:
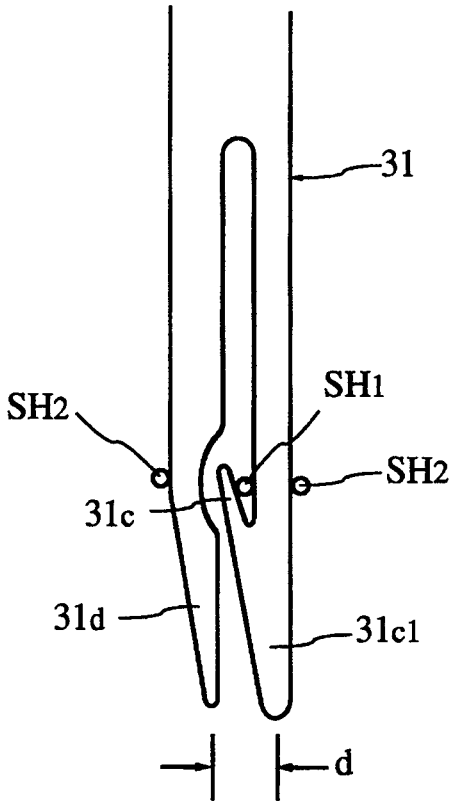
FIG. 14 is an explanatory drawing of the principal parts of another structural example of the hook of the embodiment.

As shown in FIG. 14, hook 31 may be provided with a separator 31*d* which covers hooked portion 31*c* in order to prevent normal yarn SH2 adjacent to defective yarn SH1 from being unnecessarily pulled up. The back of separator 31*d* is obliquely formed, and a sufficiently narrow gap is formed at the center of the said obliquely angled portion and front end portion 31cl integrally connected to hooked portion 31*c*, so that defective yarn SH1 is separated from normal yarn SH2 and reliably led towards hooked portion 31*c*, which is located deep inside the gap. Hook 31 may also be provided with an appropriate detent at hooked portion 31*c* in order to prevent a defective yarn SH1 from coming off from hook 31 inadvertently. Furthermore, instead of mechanically catching a defective yarn SH1 by means of a hooked portion 31*c*, the hook 31 may use an appropriate suction pipe for sucking a defective yarn SH1 or combination of hooked portion 31*c* and a suction pipe to pull up a defective yarn SH1.

If combined with an appropriate take-up device, defective yarn pulling means 30 composed of such members as described above is capable of setting the portion of defective yarn SH 1 to be pulled out at any desired length. In other words, defective yarn pulling means 30 may pull a defective yarn SH1 to any extent, instead of by a specified distance determined by the stroke of hook 31 or other similar factors, until it is certain that fluff K has been pulled to reach a level above knotter 41. The length of the pulled-out portion can easily be controlled by installing another fluff detector above knotlet 41, in the path of the defective yarn being pulled. However, it is desirable to provide some means of giving an alarm and halting the pulling operation in cases where normal yarn SH2 is pulled by error, in other words, in cases where an appropriate, specified length of yarn has been pulled and the said second fluff detector has not yet detected fluff K.

If fluff detector 50 is capable of ascertaining the location of defective yarn SH1, adjustment of the position of fluff K does not necessarily call for position adjusting device MC1 but may be accomplished in accordance with inertial running distance L1, by simply moving positioning means 10 itself in the longitudinal direction of warp SH. Furthermore, if defective yarn pulling means 30 is capable of pulling out a defective yarn SH1 by any desired length, it is not necessary to move positioning means 10 in the longitudinal direction of warp SH. Nevertheless, operating either or both of position adjusting device MC1 and positioning means 10 for quickening the entire process presents no problem.

Although knotter 41 in the embodiments described above is of such a type as to be capable of cutting a defective part of yarn SH1 and tying the cut yarn simultaneously (for example, VARITENS 835 type manufactured by MESDAN Corp. in Italy), it may comprise separate units respectively assigned for cutting and tying operations. Furthermore, it is possible to construct a semi-automatic system, which calls for manually cutting and relying a pulled-out defective yarn, by removing knotter 41 from any embodiment described above.

Having described the preferred embodiments of the invention with reference to the accompanying drawings, it is to be understood that the invention is not limited to these precise embodiments, and that various changes and modifications may be effected therein by one skilled in the art without departing from the scope or spirit of the invention as defined in the appended claims.

What is claimed is:

1. Apparatus for correcting a defect in a yarn in a warp, comprising:

a yarn pulling device;

automatic means for positioning said yarn pulling device aligned with said yarn containing said defect;

said yarn pulling device including a hook;

said yarn pulling device further including means for engaging said hook with said yarn containing said defect, and for pulling said yarn away from said warp;

means for cutting and knotting said yarn, whereby said defect is removed;

means for enabling pulling of said warp from a creel when said yarn pulling device pulls said yarn away from said warp, whereby said yarn containing said defect is permitted to be pulled;

means for applying a tension on said warp after said cutting and knotting; and means for gradually permitting said yarn to return to said warp after application of said tension on said warp, whereby slack in said yarn is prevented.

2. A method for correcting a defect in a yarn in a warp, comprising:

providing a yarn pulling device:

automatically positioning said yarn pulling device aligned with said yarn containing said defect;

engaging a hook of said yarn pulling device with said yarn containing said defect;

enabling pulling of said warp from a creel when said yarn pulling device pulls said yarn away from said warp, whereby said yarn containing said defect is permitted to be pulled;

pulling said yarn away from said warp;

cutting and knotting said yarn, whereby said defect is removed;

applying a tension on said warp after said cutting an knotting; and gradually permitting said yarn to return to said warp after application of said tension on said warp, whereby slack in said yarn is prevented.

* * * * *